US007500327B2

(12) United States Patent
Bubits

(10) Patent No.: US 7,500,327 B2
(45) Date of Patent: Mar. 10, 2009

(54) PISTOL WITH A TRIGGER MECHANISM

(75) Inventor: Wilhelm Bubits, Brunn am Gebirge (AT)

(73) Assignee: Caracal International LLC, Abu Dhabi (AE)

( * ) Notice: Subject to any disclaimer, the term of this patent is extended or adjusted under 35 U.S.C. 154(b) by 304 days.

(21) Appl. No.: 11/629,037

(22) PCT Filed: May 24, 2005

(86) PCT No.: PCT/IB2005/001405

§ 371 (c)(1),
(2), (4) Date: Dec. 8, 2006

(87) PCT Pub. No.: WO2006/000851

PCT Pub. Date: Jan. 5, 2006

(65) Prior Publication Data

US 2008/0263926 A1 Oct. 30, 2008

(30) Foreign Application Priority Data

Jun. 9, 2004 (AT) ..... A 1003/2004

(51) Int. Cl.
*F41A 19/35* (2006.01)

(52) U.S. Cl. ..... 42/69.02; 42/69.03; 89/147

(58) Field of Classification Search ..... 42/69.02, 42/69.03; 89/147
See application file for complete search history.

(56) References Cited

U.S. PATENT DOCUMENTS

| | | | | | |
|---|---|---|---|---|---|
| 4,275,640 | A * | 6/1981 | Wilhelm | 89/147 |
| 4,361,072 | A * | 11/1982 | Karlsen | 89/154 |
| 4,539,889 | A | 9/1985 | Glock | |
| 5,149,898 | A * | 9/1992 | Chesnut et al. | 42/69.01 |
| 5,179,233 | A | 1/1993 | du Plessis | |
| 5,400,537 | A * | 3/1995 | Meller et al. | 42/69.03 |
| 5,402,593 | A * | 4/1995 | Lenkarski et al. | 42/70.06 |
| 5,640,794 | A | 6/1997 | Gardner et al. | |
| 5,701,698 | A * | 12/1997 | Wesp et al. | 42/69.02 |
| 5,705,763 | A | 1/1998 | Leon | |
| 6,263,607 | B1 | 7/2001 | Fuchs et al. | |
| 6,665,973 | B1 * | 12/2003 | Peev | 42/69.01 |
| 7,051,467 | B1 * | 5/2006 | Huber | 42/69.01 |
| 2005/0034345 | A1 * | 2/2005 | Beretta | 42/69.03 |
| 2005/0108914 | A1 * | 5/2005 | Thomele | 42/69.03 |
| 2006/0249014 | A1 * | 11/2006 | Curry | 89/196 |

* cited by examiner

*Primary Examiner*—Bret Hayes
(74) *Attorney, Agent, or Firm*—Greer, Burns & Crain, Ltd.

(57) ABSTRACT

A pistol includes of a pistol body, a slide and a trigger mechanism which includes: a firing bolt, a horizontal control ramp in the slide, a guide coulisse and a guide finger cooperating with the former, a control spring fastened in the pistol body and deflectable in transverse direction, and a trigger bar hinged to a trigger and cooperating with the control ramp, the guide coulisse and the control spring, the trigger bar having a catch nose retaining the firing bolt lug. To achieve enhanced smooth-running and reproducible precision with a minimum of production costs, the control spring has a disc in its upper end region, the contour of said disc being round in the plane of the trigger bar, and the trigger bar has a substantially vertical catch nose in its rear end region and an oblique rear edge cooperating with said disc.

7 Claims, 5 Drawing Sheets

PISTOL WITH A TRIGGER MECHANISM

BACKGROUND

The invention relates to a pistol comprising a pistol body including a trigger mechanism, and a slide including a barrel and a breech, said slide being displaceably guided on the pistol body against the force of a return spring, the trigger mechanism as a whole consisting of a firing pin unit with a spring-biased firing bolt having a downwardly extending firing bolt lug; a horizontal control ramp in the slide; a guide located in a vertical plane and formed by a guide coulisse and a guide finger cooperating with the former; a control spring fastened with its lower end in the pistol body, said control spring having an upper end region deflectable in transverse direction and extending, at the top, into the path of the control ramp; and a trigger bar having a front end hinged to a trigger and a rear end region cooperating with the control ramp, the guide and the control spring, which trigger bar in turn acts on the firing bolt lug by means of a catch nose.

Such a pistol is known from U.S. Pat. No. 4,825,744, FIGS. 27 to 29. Therein, the guide coulisse is punched in the rear end region of the trigger bar, the latter thereby being weakened at a location where strength and precision are important. The control spring is fastened in the pistol body made of plastics, and at its upper end it has a bent plane abutment surface for the rear end of the trigger bar. Its position in the pistol body and the position of the abutment surface thus involve great tolerances. This latter fact is a problem since the precision of triggering depends on it. For triggering the shot, the rear end of the trigger bar slides downwards on the abutment surface, and for this purpose, moreover, the friction between these two surfaces must be overcome. As a consequence both the position of the pressure point and also the trigger weight become imprecise, both of them are not adjustable. As a catch nose, the trigger bar has a tongue arranged very far rearwardly on a thin, horizontal web and inclined rearwardly under an acute angle and to the middle, which tongue has a surface cooperating with the firing bolt lug that must be oblique because of the inclination, yet must be machined with the highest precision. The acute angle is difficult to maintain by bending, because of the resilience of the sheet. With this design and arrangement, the trigger bar has a weak structure and is difficult to produce with sufficient precision. Despite the fact that the parts of the trigger as a whole are expensive to produce, they nevertheless have inherent tolerances.

SUMMARY

Thus, it is an object of the invention to improve a trigger mechanism of this type to the effect that a maximum of smooth running and reproducible precision is achieved with a minimum of production costs. Further advantages are mentioned in the specification. According to the invention, the above is achieved in that the control spring, in its upper end region, has a disc which, in its resting position, projects into the path of movement of the trigger bar, the disc having a contour which, in the plane of the trigger bar, is round, and that the trigger bar, in its rear end region, has a substantially vertical catch nose and an oblique rear edge cooperating with the disc. This rear edge contacts the disc only along a generatrix of its contour and, thus, with less friction. The disc can be positioned on the control spring with high precision. The vertical catch nose can project upwardly from the trigger bar without any folding. Thus, folding, which is always somewhat imprecise, can be avoided, and the tip of the nose can be machined at right angles. This, too, enables an increased precision at lowered production costs.

Preferably, a functional member consisting of two interconnected vertical metal plates is built in within the pistol body, the guide coulisse being formed in said functional member and the control spring being fastened in the same. In this way, the more precise parts can also be positioned with exactness in the metal base body, which also contributes to the precision.

A further increase in the precision at lowered production costs is achieved if the disc has a circular contour. Furthermore, trigger pull and pressure point can be chosen, or even readjusted, if the disc is removably fastened to the control spring, and is exchangeable.

The invention is particularly advantageously applicable if the firing pin unit is an insertion member that includes the firing bolt, wherein the firing bolt spring is arranged above the firing bolt, and the firing bolt lug projects downwards from the insertion member near the longitudinal middle of the firing pin unit. By this design, the firing bolt lug can be arranged further up front on the firing bolt, resulting in a shorter trigger bar and making the vertical position of the catch nose easier to achieve. Namely, if the firing bolt spring surrounds the firing bolt as is common in the prior art, the catch nose must be located at the very rear.

In a preferred embodiment, the trigger bar is a full-material punched part having a rear region with two rectangular bent portions with approximately vertical bending edges, wherein the first bent portion is reinforced by a lobe folded into the horizontal from the part of the trigger bar between the two bent portions, and this lobe forms the guide finger. Seen in top view, these two bent portions, in alternate directions, give the trigger bar the shape of a Z. Due to the reinforcement, it can extend far into the middle without bending under load, which increases the stiffness. The guide finger is provided in the plane of the lobe and, therefore, can be produced with exactness at little expenditure. The freedom of shape achieved by the reinforced trigger bar also allows for a particularly simple firing bolt safety: in its longitudinally middle region, the trigger bar has a coulisse which cooperates with a hook engaging the firing bolt, which hook, thus, forms the trigger safety.

If the catch nose projects upwards from the part of the trigger bar between the two bent portions and is located in a plane with said part, the catch nose is well-supported by the reinforcement and can be made without folding, i.e. without deviation in dimension, in a plane with the associated section of the trigger bar.

BRIEF DESCRIPTION OF THE DRAWINGS

In the following, the invention will be described and explained by way of figures and an exemplary embodiment of the invention.

DETAILED DESCRIPTION OF THE PREFERRED EMBODIMENT

Figure 2:
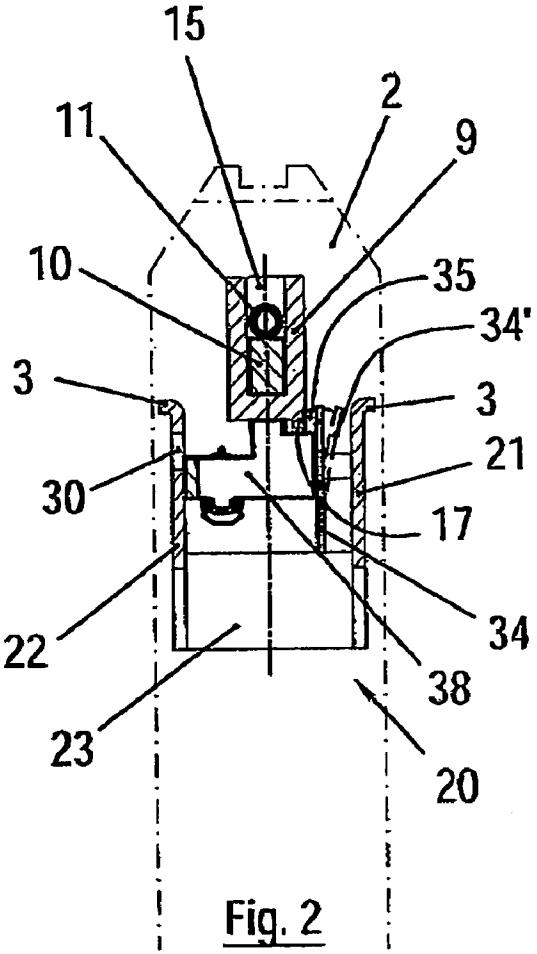
FIG. 2 is a view according to II in FIG. 1.
Figure 1:
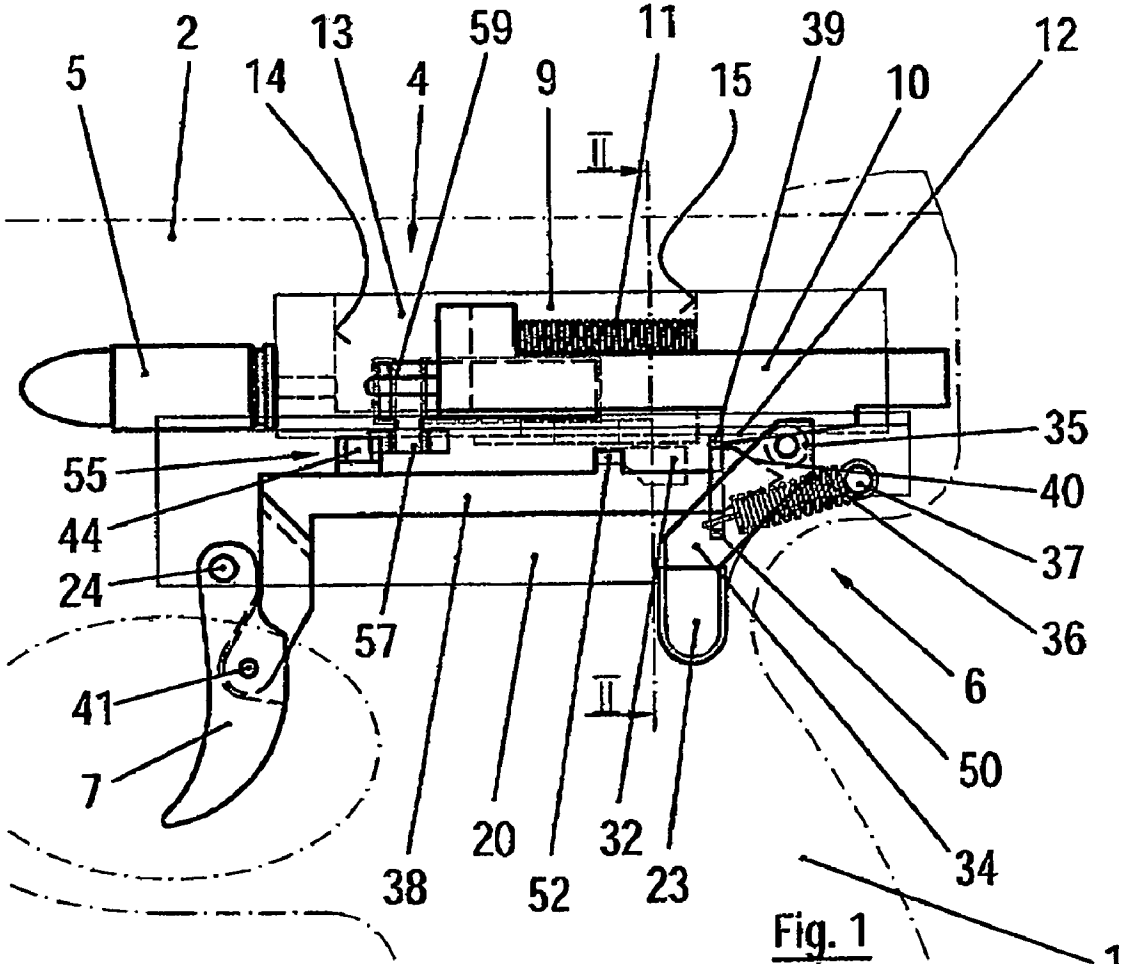
FIG. 1 is a section in a vertical longitudinal plane in the cocked state.
Figure 3:
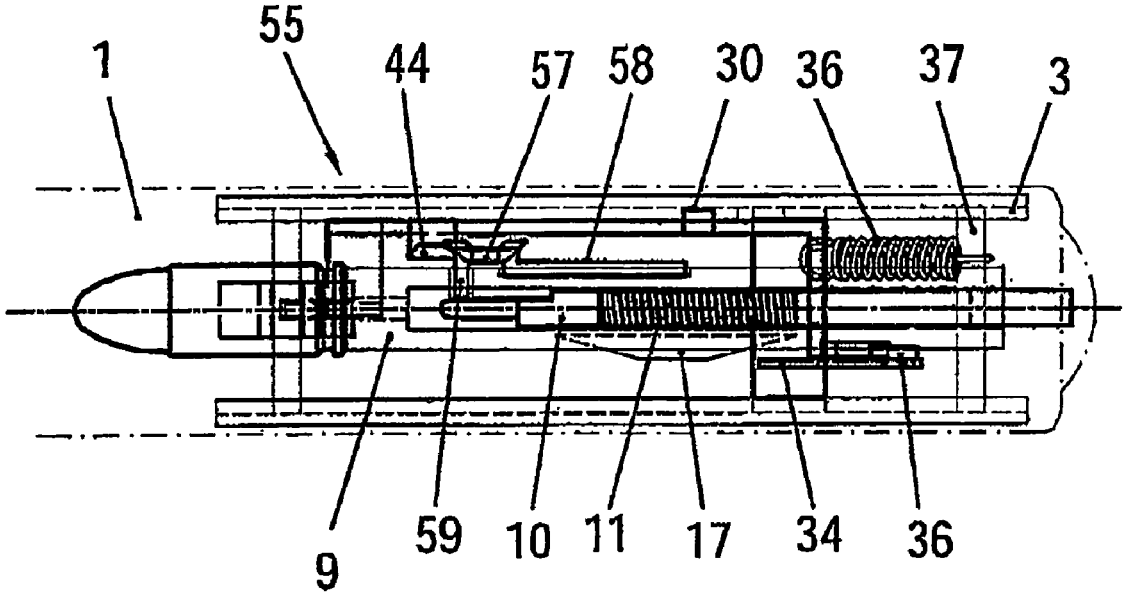
FIG. 3 is a top view to FIG. 1.
Figure 4:
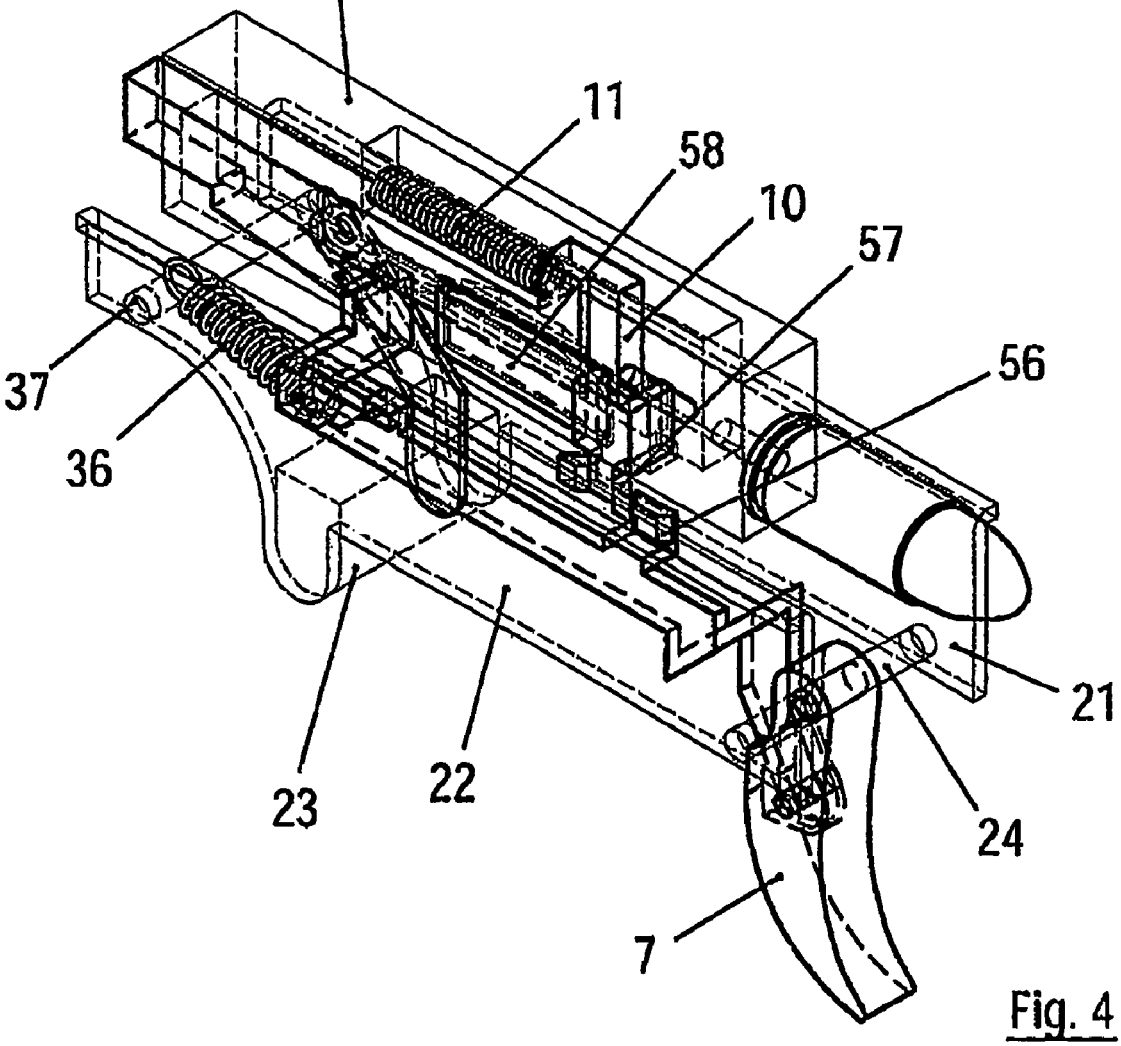
FIG. 4 is an axonometric view of FIG. 1.

In FIGS. 1, 2 and 3, a pistol body 1 is merely partially indicated by a dot-and-dash contour, just as is a slide 2 which is displaceable in guides 3 on the pistol body 1. In the part illustrated, the slide 2 contains a breech 4 and, in front thereof and not illustrated, a barrel and a return spring. For representative purposes, a loaded round 5 is shown. Furthermore, there is a trigger mechanism indicated by 6 and actuated from a trigger 7. In the slide 2, a firing pin unit designated by 9 as a whole is inserted and fastened, which firing pin unit 9 has a cavity 13 in which a firing bolt 10 is received. The firing bolt 10 has a firing bolt lug downwardly protruding from the firing pin unit 9, the front edge of the firing bolt lug being located comparatively far up front thanks to another inventive measure. Above the body of the firing bolt 10, a firing bolt spring 11 is provided whose rear side rests against an abutment face 15 and aims at throwing the firing bolt 10 forward. Thus, the firing bolt spring 11 is eccentrically arranged. In the position illustrated, the pistol is cocked and ready for firing. For firing, merely the trigger 7 need be actuated. Finally, a control ramp 17 is provided in the slide, which control ramp cooperates with the trigger mechanism 6 in a manner yet to be described.

In the pistol body 1, which according to present technology may be an injection-moulded plastic part, a functional member 20 is inserted. It consists of a left-hand and a right-hand side plate 21, 22 each having a folded upper rim and each forming a guide 3 for the slide 2. Between the two side plates 21, 22, a connecting block 23, and, as further connecting elements, an axle 24 about which the trigger 7 is pivotable, and a further pin 37 are provided. Thus, the functional member 20 constitutes a unit comprising the essential parts of the trigger mechanism 6, which unit can be inserted into the pistol body in a completely assembled state.

Figure 6:
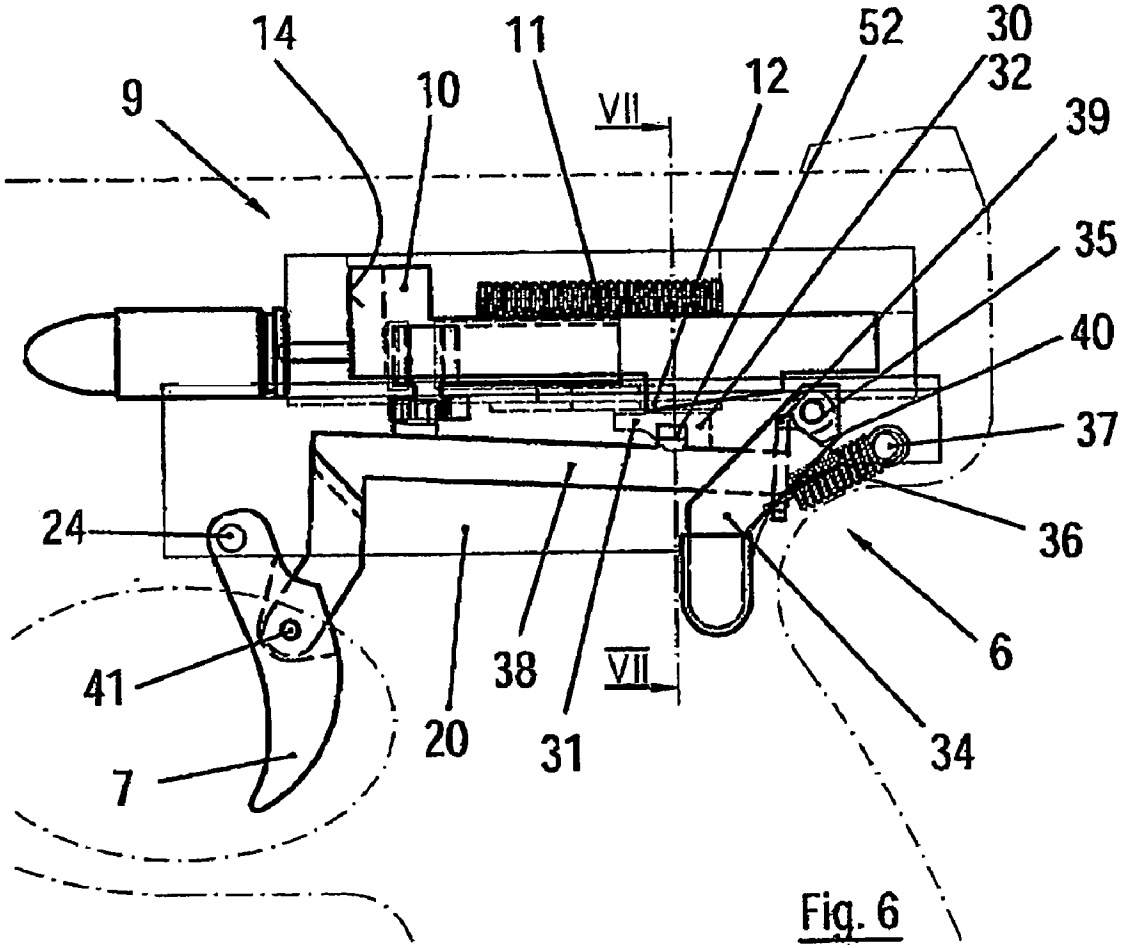
FIG. 6 is a section in a vertical longitudinal plane, in the released state.
Figure 8:
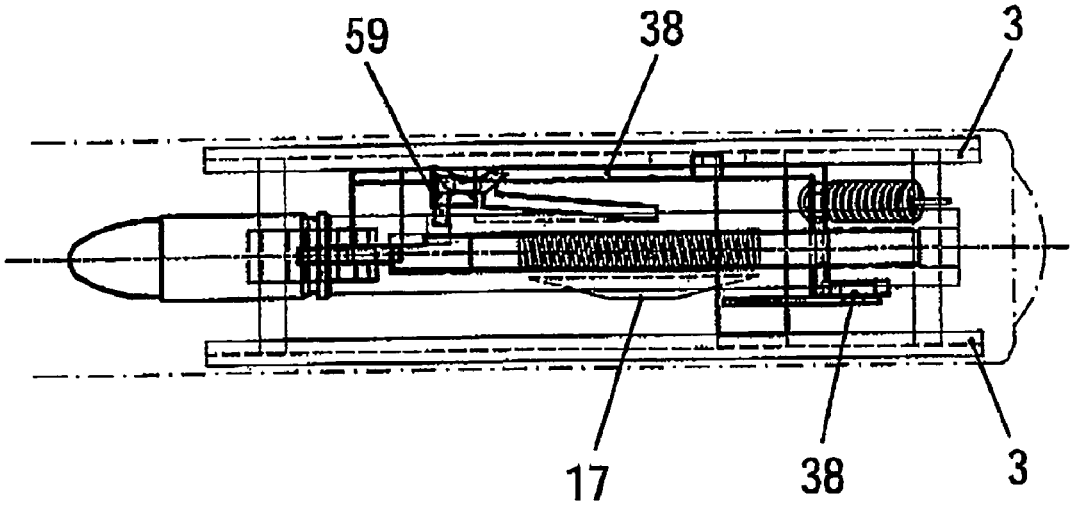
FIG. 8 is a top view of FIG. 6.
Figure 9:
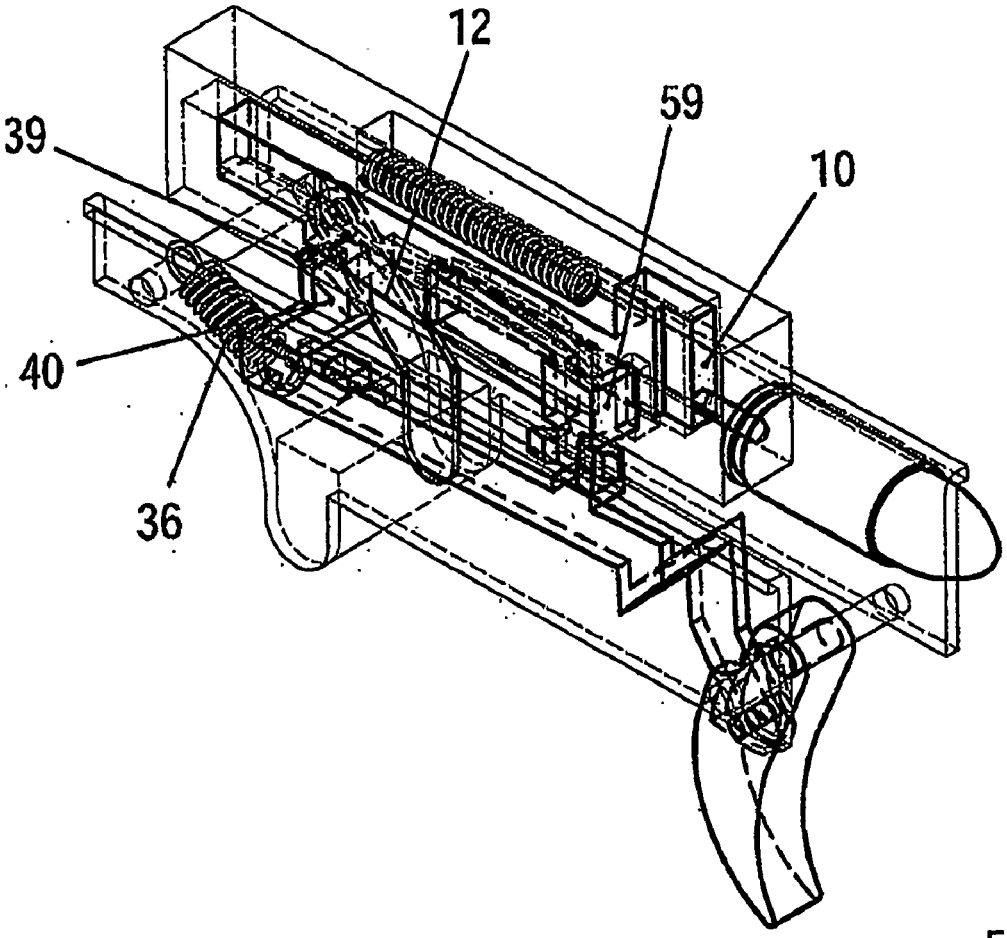
FIG. 9 is an axonometric view of FIG. 6.

In the right-hand side plate 22 of the functional member 20, a window-shaped guide coulisse 30 is punched out. It consists of a narrow forward part (cf. FIG. 6), and a rearwardly adjoining high part 32. In the connecting block 23, the base of a control spring 34 is tightly inserted and clamped. If the connecting block is made of plastics, it is injection-moulded into it. In FIG. 2, the control spring is indicated in broken lines also in its deflected state 34'. In the upper, freely transversely pivotable region of the control spring 34, a disc 35 pointing towards the longitudinal plane of symmetry of the pistol is fastened. It is of cylindrical shape, the generatrix of the cylinder extending perpendicularly to the plane of the control spring 34. The disc 35 may be a cylinder of any plan view, yet preferably it is a circular disc. Furthermore, a trigger bar 38 which, with its catch nose 39, prevents a rapid forward movement of the firing bolt 10 is provided in the functional member 20. A tension spring 37 anchored in the functional member 20 via a pin 37 acts on the trigger bar 38, and with its other end, the tension spring engages the trigger bar 38 actuating the latter rearwardly and upwardly.

Figure 5:
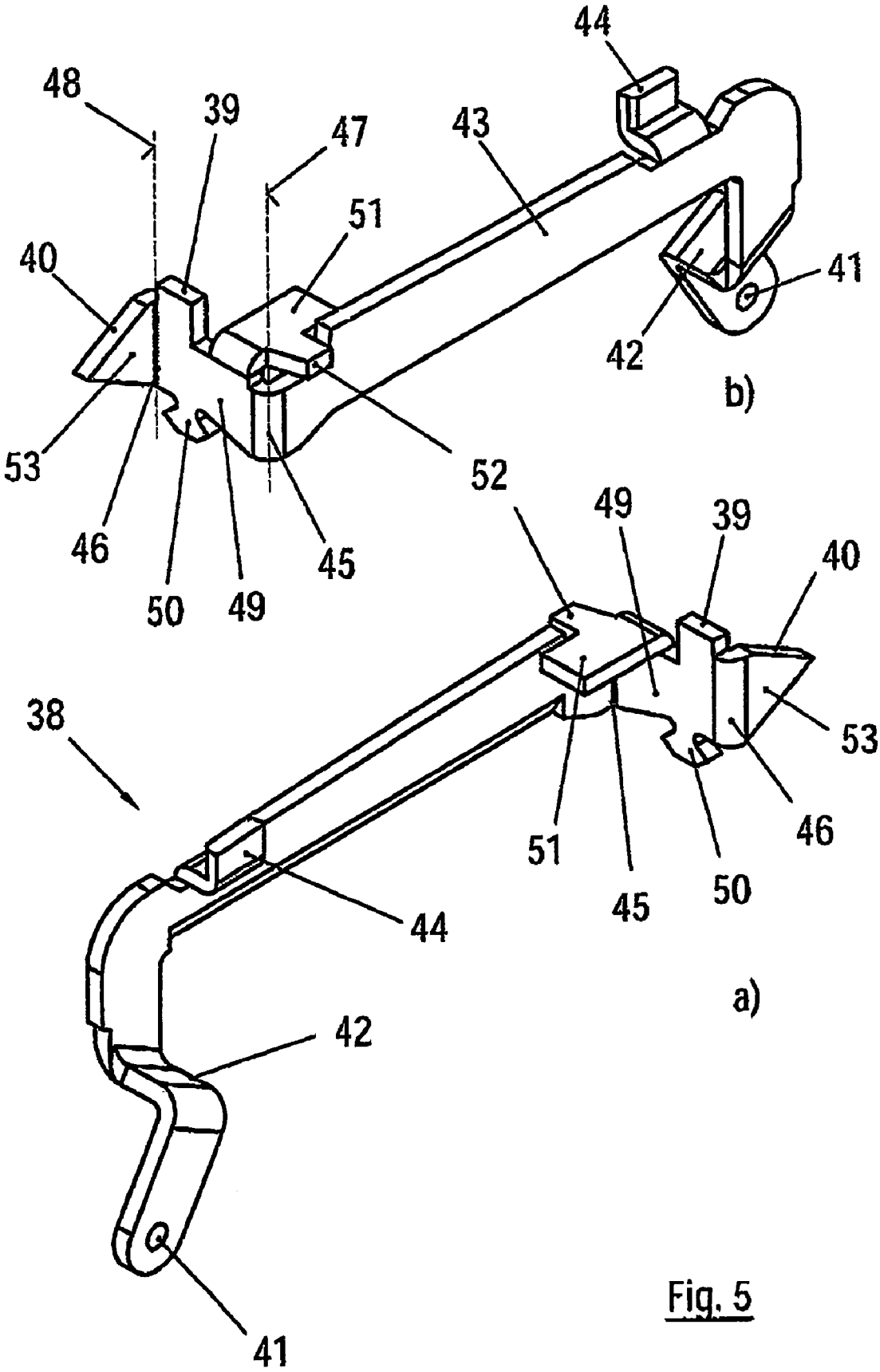
FIG. 5 depicts the trigger bar, enlarged, once viewed from the left front side (a), once viewed from the right rear side (b)
Figure 7:
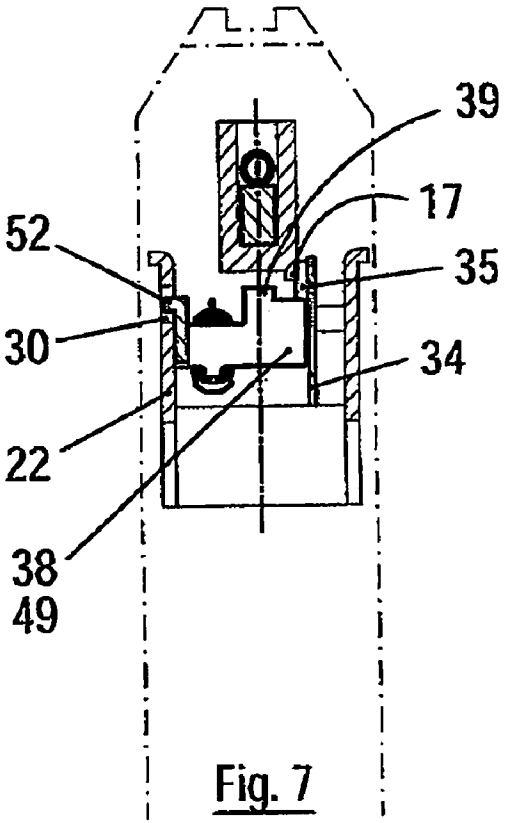
FIG. 7 is a view according to VII in FIG. 6.

In FIG. 5, only the trigger bar 38 is visible, once obliquely from the front side (a), and once obliquely from the rear side (b). It consists of a single, punched part of metal sheet which subsequently is folded several times. In its front region, it has a bore for a pin 41 connecting it to the trigger 7. There follows a cranked part 42, by means of which a middle part 43 (the bar proper) comes to lie entirely at the side (i.e. immediately adjacent the right-hand side plate 22) in the functional member 20. A coulisse 44 for a firing bolt safety is formed by two-fold bending relatively far up front. At the rear end of the long middle part 43, there are a first and a second bent portion 45, 46 along approximately vertical bending lines 47, 48. These two bent portions 45, 46 lead to a rectangular Z-like shape, seen in top view, with the transverse part 49 formed between the two bent portions 45, 46 also being approximately vertical. The transverse part 49 is plane and forms the catch nose 39 in the plane upwards, and a hook 50 downwards, the tension spring 36 engaging on said hook 50. A portion of this transverse part 49 is folded forwards at right angles and forms a lobe 51 which has two functions: it reinforces the transverse part 49 relative to the middle part 43 of the trigger bar such that in any case the right angle between the middle part and the transverse part 39 will be maintained when a pressure force acts at the middle part 43. As its second function, the lobe 51 is extended to beyond the middle part 43 and forms a guide finger 52 which engages in the guide coulisse 30. Behind the second bent portion 46, in parallel to the plane of symmetry of the pistol, there is an end region 53 of triangular shape. What is essential at this end region is the oblique rear edge 40 which cooperates with the disc 35 in a manner yet to be described.

Again in FIGS. 1, 2 and 3, a firing bolt safety generally denoted by 55 can be seen. It is actuated by the coulisse 44 on the trigger bar 38. Namely, the latter cooperates with a ramp 57 which continues upwardly in a hook 59 which is fastened on a leaf spring 58 externally on the firing pin unit 9 and movable in transverse direction. When moving the trigger bar, the hook is pushed aside by the cooperation of coulisse 44 and ramp 57, thereby enabling the firing bolt to rapidly move forwards when subsequently it is released by the catch nose 39.

In the position shown in FIGS. 1 to 4, the weapon is cocked and ready for firing. The trigger bar 38 is in its upper position because the guide finger 52 is held in the narrow part 31 of the guide coulisse. Since the narrow part is only just as high as the guide finger 52, the trigger bar 38 has no freedom of movement in the vertical direction, it can only be displaced in the horizontal direction. When actuating the trigger 7, the trigger bar is horizontally displaced towards the rear side, the position illustrated in FIGS. 6 to 9 being reached.

In FIGS. 6 to 9, the trigger bar 38 has already been displaced towards the rear, and at first the oblique rear edge 40 of the trigger bar 38 has reached the contour of the disc 35. At the same time, the guide finger 52 has left the narrow part 31 of the guide coulisse 30 so that the trigger bar 38 is moved downwards by the cooperation of the oblique rear edge 40 with the disc 35. In doing so, also the catch nose 39 is lowered—the firing bolt 10 is released and hits forwards on the round 5.

During the subsequent return movement of the slide, the control ramp 17 (FIG. 7) presses the control spring 34 towards the outside, whereby the rear edge 40 of the trigger bar 38 gets out of engagement with the disc 35 and is pulled upwards by the tension spring 36. As in a final phase of movement the slide moves forwards again, the firing bolt lug 12 again is caught on the catch nose 39, moving the latter slightly forwards, whereby the guide finger 52 is pushed into the narrow part of the guide coulisse 30 again, thus again reaching the position of FIGS. 1 to 3.

The invention claimed is:

1. A pistol with a pistol body including a trigger mechanism, and with a slide including a barrel and a breech, said slide being displaceably guided in the pistol body against the force of a return spring, which trigger mechanisms comprises:

a) a firing pin unit with a firing bolt that includes a downwardly extending firing bolt lug, and with a firing bolt spring eccentrically arranged with respect to the firing bolt and resiliently acting on the bolt;

b) a horizontal control ramp in the slide;

c) a control spring fastened with a lower end in the pistol body, an upper end region thereof being deflectable in transverse direction and extending, at the top, into the path of the control ramp;

d) a guide located in a vertical plane and consisting of a guide coulisse and a guide finger cooperating with the guide coulisse;

e) a trigger bar having a front end hinged to a trigger and the guide finger cooperating with the guide coulisse in a rear end region, said trigger bar cooperating with the control ramp as well as with the control spring and acting on the firing bolt lug by a substantially vertical catch nose arranged in the rear end region of said trigger bar;

f) the trigger bar is a full-material punched part having a rear region with two rectangular bends with vertical bending lines, wherein the first bend is reinforced by a lobe folded into the horizontal from a part of the trigger bar between the two bends, the lobe forming the guide finger;

g) the control spring, in an upper end region, has a disc which, in a resting position, projects into the path of movement of the trigger bar, the disc having a contour which, in the plane of the trigger bar, is round; and wherein h) the trigger bar has an oblique rear edge cooperating with the disc.

2. The pistol according to claim 1, characterised in that a functional member consisting of two interconnected vertical metal plates is fastened in the interior of the pistol body, the guide coulisse being formed in said functional member and the control spring being fastened in the functional member.

3. The pistol according to claim 1, characterised in that the disc has a circular contour.

4. The pistol according to claim 3, characterised in that the disc is removably fastened to the control spring (34) and is exchangeable.

5. The pistol according to claim 1, characterised in that the firing pin unit is an insertion member that includes the firing bolt, wherein the firing bolt spring is arranged above the firing bolt, and the firing bolt lug projects downwards near the longitudinal middle of the firing pin unit.

6. The pistol according to claim 1, characterised in that the catch nose projects upwards from the part of the trigger bar between the two bends, the catch nose being located in a plane with said part.

7. The pistol according to claim 1, characterised in that in a longitudinal middle region, the trigger bar has a coulisse which cooperates with a hook engaging the firing bolt, thereby forming a trigger safety.

* * * * *